US005400720A

United States Patent [19]

Stevens

[11] Patent Number: 5,400,720

[45] Date of Patent: Mar. 28, 1995

[54] LIFT AND TILT TABLE

[75] Inventor: Jay B. Stevens, Angola, Ind.

[73] Assignee: Vestil Manufacturing Company, Angola, Ind.

[21] Appl. No.: 44,188

[22] Filed: Apr. 7, 1993

[51] Int. Cl.[6] ..... A47B 9/00

[52] U.S. Cl. ..... 108/147; 248/420; 248/394; 248/396

[58] Field of Search ..... 108/7, 9, 1, 5, 6, 145, 108/147, 138, 10; 248/420, 394, 396

[56] References Cited

U.S. PATENT DOCUMENTS

| | | | |
|---|---|---|---|
| 1,453,406 | 5/1923 | Purvis . | |
| 1,581,874 | 4/1926 | Rumfelt . | |
| 2,013,542 | 9/1935 | Nordmark | 108/5 X |
| 2,563,060 | 8/1951 | O'Neill | 108/6 |
| 2,928,558 | 3/1960 | Bamford et al. | 108/147 X |
| 3,094,948 | 6/1963 | Clow | 108/10 |
| 3,203,670 | 8/1965 | Farris | 108/147 X |
| 3,282,566 | 11/1966 | Clarke | 108/147 X |
| 4,531,720 | 7/1985 | Soder . | |
| 4,577,821 | 3/1986 | Edmo et al. | 108/145 |
| 4,685,731 | 8/1987 | Migut | 108/147 X |
| 4,705,438 | 11/1987 | Zimmerman et al. | 108/9 X |
| 4,723,769 | 2/1988 | Nilsson . | |
| 4,760,997 | 8/1988 | Fager . | |
| 4,767,109 | 8/1988 | Raketich . | |
| 4,796,029 | 1/1989 | Duppong et al. . | |

FOREIGN PATENT DOCUMENTS

| | | | |
|---|---|---|---|
| 915556 | 1/1963 | United Kingdom | 108/147 |

*Primary Examiner*—Jose V. Chen
*Attorney, Agent, or Firm*—George Pappas

[57] ABSTRACT

A lift and tilt table including an upper platform which is raised and lowered over a lower platform. A table is provided over the upper platform and at one end thereof is adapted for only horizontal movement over the platform. A pair of arms and a pair of selectively actuated hydraulic cylinders are pivotally connected between the upper platform and the table. Actuation of the hydraulic cylinders causes the table free end to be lifted above the platform while the table is caused to simultaneously move in a horizontal direction for retaining the center of gravity of the table generally over the same area on the platform. An apron is provided on the table for preventing articles placed on the table from sliding off therefrom and the apron moves horizontally with the table so as not to extend over the edge of the platform.

18 Claims, 2 Drawing Sheets

LIFT AND TILT TABLE

TECHNICAL FIELD

The present invention relates to the technical field of material moving and handling. More specifically, the present invention relates to tables used for lifting and tilting loose articles and material for use, for example, in manufacturing processes so that the articles and materials are more easily accessible.

BACKGROUND OF THE INVENTION

Lift and tilt tables, for example as shown in FIG. 1 of the present application, are presently commonly used for lifting and tilting loose articles and materials to a more convenient easily accessible location. These prior art tables, as shown in FIG. 1, include a scissor lift mechanism generally indicated as 10 which includes criss-cross legs 12 and 14 pivotally and slidingly engaging upper horizontal platform 16 and lower horizontal platform 18. Scissor lift mechanism 10 causes upper horizontal platform 16 to be selectively lifted upwardly as needed. A tilt table 20 is pivotally connected with a hinge member 22 to upper horizontal platform 16. A hydraulic cylinder 24 is pivotally connected to upper horizontal platform 16 at one end and to table 20 at its other end. Loose articles or material components are placed within a bin 26 placed on tilt table 20 or are placed directly on the tilt table itself. By selectively actuating hydraulic cylinder 24, tilt table 20 is caused to pivot about the pivot axis of hinge member 22 and bin 26 along with articles therein are caused to be moved upwardly and pivoted as shown in FIG. 1. An apron or extension 28 is connected to tilt table 20 and extends generally upwardly therefrom to prevent bin 26 and/or articles on table 20 from sliding off therefrom. In this fashion, by controlling the height of upper horizontal platform 16 and the angle of tilt table 20 with respect to upper horizontal platform 16, the articles within bin 26 are placed in an optimum position, for example, for an operator to reach within bin 26 and grab or otherwise obtain an article or material component for use in a manufacturing process. Such a lift and tilt table, as can be appreciated, can also be used for placing articles and other items within a bin 26 after they have been exposed to the manufacturing process and in many other applications.

The prior art lift and tilt tables, however, have substantial shortcomings and drawbacks. One substantial shortcoming is that as tilt table 20 is pivoted about hinge member 22, the center of gravity of the table and articles within bin 26 is caused to shift towards hinge 22. Depending on the weight of the carried articles and the weight of the overall lift and tilt table and center of gravity thereof, as the angle between tilt table 20 and upper horizontal platform 16 increases, it is possible to cause the entire lift and tilt table along with bin 26 and articles therein to fall over. Most often, however, it is desirable to place tilt table 20 at a substantially large angle with respect to upper platform 16 so that articles within bin 26 may be placed at the most optimum location.

One solution for solving the above-discussed disadvantage with prior art tables is to increase the size of lower horizontal platform 18. This, however, is undesirable because the enlarged lower platform 18 then is in the way of the operator, forklifts, and other machinery that must pass or travel nearby the table.

Another drawback of the prior art lift and tilt tables is that, as tilt table 20 is caused to pivot about hinge 22, apron 28 and bin 26 are caused to extend to the right as shown in FIG. 1 and beyond the side end of upper platform 16. Again, the protruding apron 28 and bin 26 tend to get in the way of forklifts and other machinery. In addition, although the entire lift and tilt table could be set back to compensate for the ultimately extending apron 28 and bin 26, the operator does not easily know how far to set back since the total extension will depend on the angle between tilt table 20 and upper platform 16 along with the overall height of bin 26.

Accordingly, a need exists for a lift and tilt table capable of lifting and tilting a bin with articles therein in an optimum position for an operator reaching within the bin and which further remains stable during the tilting operation and which is not caused to extend beyond the upper platform when tilted.

SUMMARY OF THE INVENTION

It is the principal object of the present invention to overcome the above-discussed disadvantages and drawbacks associated with prior lift and tilt tables.

The present invention overcomes the disadvantages associated with prior lift and tilt tables by lifting a table first end above the upper horizontal platform and simultaneously moving the tilt table in a horizontal direction towards the table first end. The table opposite or second end is caused to slide along the upper platform in a direction towards the tilting table first end.

More specifically, the tilt table of the present invention includes two arms each pivotally connected at one end to the upper platform and at their other end to the tilt table. Two hydraulic cylinders are also each connected at one end to the upper platform and at the other end to the tilt table. The hydraulic cylinders extend and cause the tilt table first end to be forced toward and against the two arms in a manner whereby the two arms are placed in compression when holding the first end of tilt table up in a tilted position. The second end of the tilt table includes two rollers rotatably connected thereto and adapted for engaging respective channels which are affixed to the upper platform. The rollers and channels, thus, retain the table second end in sliding engagement with the platform as the hydraulic cylinders and arms cause the first end of the tilt table to be pivoted vertically upwardly and to be moved horizontally in the direction of the tilt table first end. In this fashion, the center of gravity of the tilt table and articles placed thereon is caused to remain vertically above the general vicinity of an area on the upper platform and not move towards the table second end as the table is tilted. Furthermore, an apron connected to the tilt table second end and extending upwardly therefrom is retained above the upper platform and is not allowed to extend beyond the platform. This is due to the sliding movement of the entire tilt table on the upper platform towards the first tilt table end.

In one form thereof, the present invention is directed to a tilt table including a platform and a table on the platform having first and second ends. A mechanism is provided for lifting the table first end above the platform and simultaneously moving the table in a horizontal direction towards the table first end. Accordingly, a center of gravity of the table is retained vertically above the general vicinity of an area on the platform while articles placed on the table are tilted towards the table second end.

Preferably, the tilt table includes a scissor lift mechanism below the platform. The scissor lift mechanism is connected between the platform and a lower platform for lifting the platform vertically above the lower platform. Yet more preferably, the mechanism for lifting and simultaneously moving includes an arm pivotally connected at one end to the platform and pivotally connected at its other end to the table. A retaining mechanism is provided for retaining the table second end in sliding engagement with the platform. Further, an extension mechanism is provided and is pivotally connected at one end to the platform and is pivotally connected at its other end to the table for selectively pushing the table vertically upwardly and in a direction towards the table first end. The extension mechanism can be a selectively actuated hydraulic cylinder. The retaining mechanism can be a channel attached to the platform and a roller rotatably connected to the table second end and engaging the channel. An apron may be provided on the table second end and extending upwardly therefrom for preventing articles placed on the table from sliding off therefrom when the table first end is lifted above the platform. Most preferably, the hydraulic cylinder and arm are pivotally connected between the platform and table in a fashion whereby they criss-cross when viewed from a side thereof when the table is being lifted.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF THE SPECIFIC EMBODIMENTS

Figure 1:
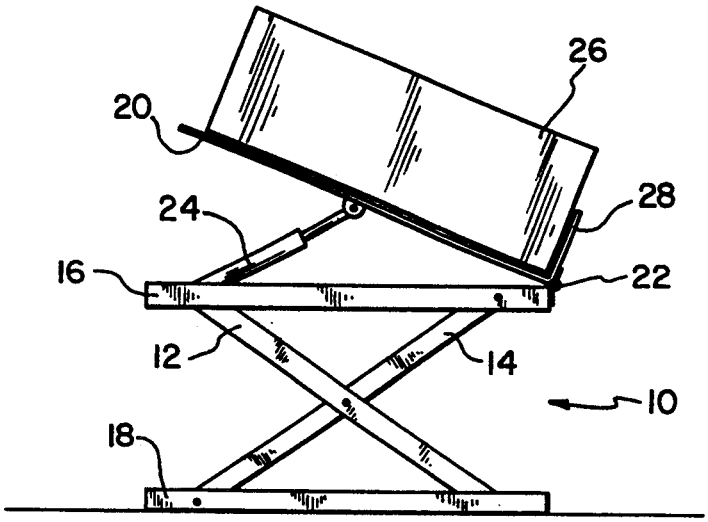
PRIOR ART FIG. 1
FIG. 1 is a side elevational diagrammatic view of a prior art lift and tilt table.
Figure 2:
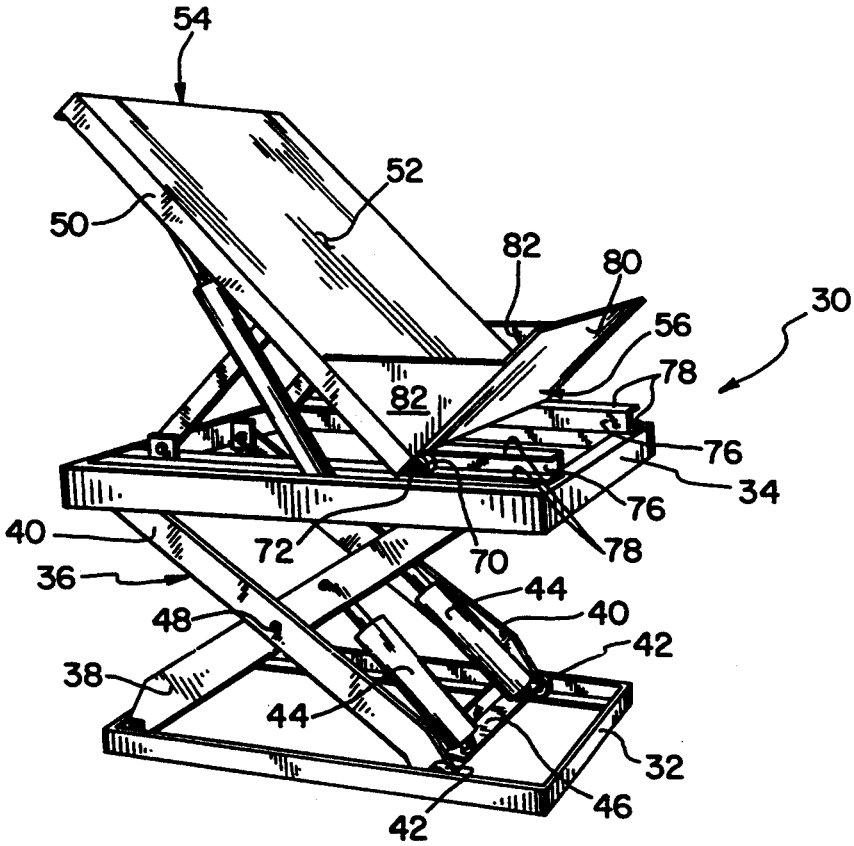
FIG. 2 is a perspective view of a lift and tilt table according to the present invention.
Figure 3:
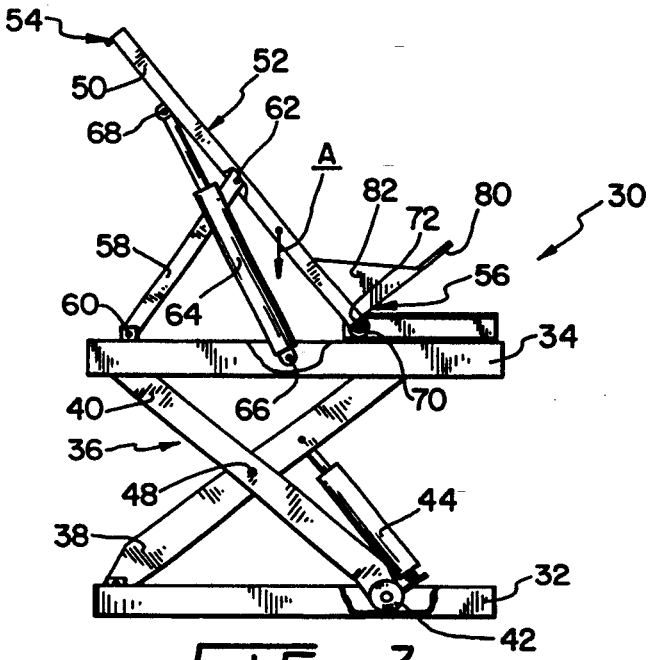
FIG. 3 is a side elevational view of the lift and tilt table shown in FIG. 2 and showing the tilt table in the pivoted lifted position.
Figure 4:
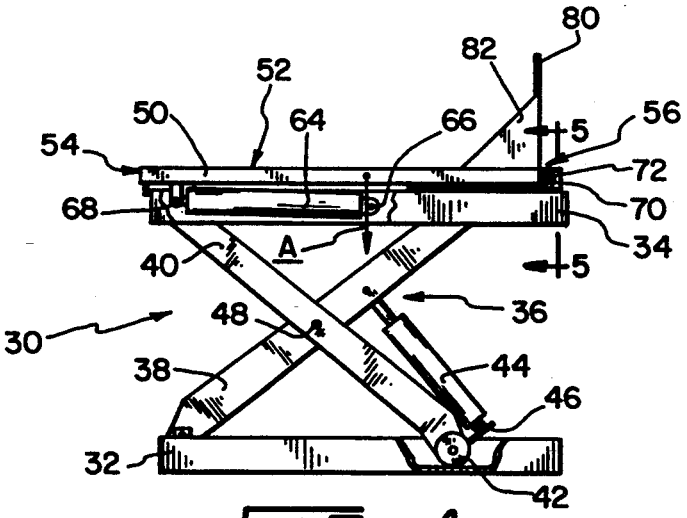
FIG. 4 is a side elevational view of the lift and tilt table shown in FIG. 2 and showing the tilt table in the retracted horizontal position; and, FIG. 5 is a partial cross-sectional view along line 5—5 in FIG. 4 and showing a roller and channel according to the present invention.
Figure 5:
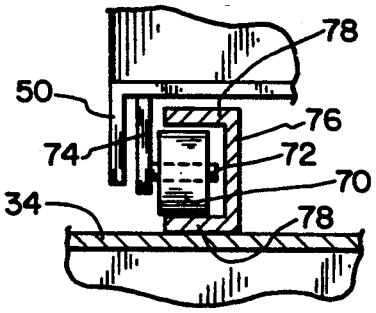

Referring now to FIGS. 214 5, a lift and tilt table according to the present invention is generally indicated by the numeral 30. Table 30 includes a lower horizontal platform 32 and an upper horizontal platform 34 both of which are made of L-shaped steel. A scissor lift mechanism generally indicated as 36 is provided and connected between lower horizontal platform 32 and upper horizontal platform 34. Scissor lift mechanism 36 includes legs 38 each of which are pivotally connected at one end to lower platform 32 and at their other end slidingly engage platform 34 (not shown). Scissor lift mechanism also includes legs 40 which are pivotally connected to upper platform 34 at their upper ends and are adapted for sliding engagement with lower platform 32 at their lower ends. In this regard, at the lower end of legs 40, to decrease the frictional effects, there are provided rollers 42 which are adapted to roll on lower platform 32. Hydraulic cylinders 44 are provided and are pivotally connected at one end to legs 38 and at their other end to a cross bar 46 which is, in turn, affixed to legs 40. Legs 38 and 40 are further pivotally connected to one another by a pivot pin 48 in a manner whereby actuation of cylinders 44 causes legs 38 and 40 to pivot with respect to each other about pivot pin 48 and causing upper horizontal platform 34 to be raised as shown in FIGS. 2 through 4. Relaxing cylinders 44 in turn causes legs 38 and 40 to pivot about pin 48 such that they become parallel to one another and, thus, lowering upper platform 34 over lower platform 32.

Above upper platform 34 there is provided a tilt table 50 having an upper surface 52, a first end 54 and a second end 56. A pair of arms 58 are provided and are pivotally connected at one end about pivot point 60 to upper platform 34 and are pivotally connected at their other end about pivot point 62 to table 50.

A pair of selectively energized hydraulic cylinders are also provided and at one end thereof are pivotally connected about a pivot point 66 to upper platform 34 and at their other end are pivotally connected about a pivot point 68 to table 50. As shown in FIGS. 3 and 4, hydraulic cylinders 64 are adapted to selectively extend and retract between a short length as shown in FIG. 4 and longer lengths as, for example, shown in FIGS. 2 and 3.

At the table 50 second end 56 there are provided a pair of rollers or wheels 70 which are connected to table 50 and are adapted for rotational movement about axle pins 72 which are themselves affixed to table 50 via extensions 74 as more clearly shown in FIG. 5. A pair of U-shaped channels 76 having legs 78 are affixed upon upper platform 34. It is noted that channels 76, hydraulic cylinders 64 and arms 58 are all generally parallel to one another when table 50 is horizontally situated as shown in FIG. 4. Rollers 70 are partially received within U-shaped channels 76 as more clearly shown in FIG. 5 in a manner whereby rollers 70 are allowed to travel horizontally but are prevented from moving vertically upwardly and downwardly. In addition, as shown in FIG. 2, U-shaped channels 76 are affixed to upper platform 34 opposite one another or facing away from each other thereby effectively preventing table 50 from moving in a direction perpendicular to channels 76. In other words, the combination of channels 76 and rollers 70 retain the table second end 56 in general sliding engagement with upper platform 34 in a direction substantially parallel to channels 76.

An apron 80 is attached to table second end 56 and extends generally perpendicular away from table upper surface 52. The attachment of apron 80 is reinforced via triangular sections 82 connected between the edges of apron 80 and the table upper surface 52. Apron 80 is provided so as to prevent articles placed on table surface 52 from sliding off therefrom when table 50 is placed in the position shown in FIGS. 2 and 3.

In operation, table 50 has a center of gravity as diagrammatically indicated in FIGS. 3 and 4 by the point and arrow A. The center of gravity A, when table 50 is in its horizontal position, is over an area (not specifically shown) on upper platform 34. Table 50 is raised by causing hydraulic cylinders 64 to be actuated/extended. By providing hydraulic pressure and extending hydraulic cylinders 64, table 50 is forced towards table first end 54 and against arms 58. Arms 58 are thus placed in compression and start to pivot counterclockwise as viewed in FIGS. 3 and 4. The counterclockwise movement of arms 58 causes table end 54 to be lifted above upper platform 34. However, table second end 56 is restrained by rollers 72 and channels 76 and, as a result thereof, is caused to slide or move in a direction parallel to channels 76 towards the table first end 54 (to the left as shown in FIG. 3). As a result of actuating hydraulic cylinders 64, the table first end 54 is caused to be lifted above upper platform 34 and table 50 is simultaneously caused to move in a horizontal direction toward the table first end 54. When hydraulic cylinders 64 are extended as shown in FIG. 3, both arms 58 and hydraulic cylinders 64 remain in compression and retain table first end 54 at an angle with respect to upper platform 34 as shown. Furthermore, the weight of table 50 and any articles that may be placed thereon is distributed to upper platform 34 via arms 58, hydraulic cylinders 64, and also through rollers 70. Very importantly, however, due to the simultaneous horizontal movement of table 50, the center of gravity A of table 50 is caused to move along table 50 but is retained vertically above the general vicinity of the same area on upper platform 34 as when table 50 was in the horizontal position. In this fashion, the potential for tipping of table 50 is, in large part, prevented.

It is further noted that the horizontal movement of table 50 causes apron 80 to also be moved horizontally in a fashion whereby it does not extend over the side edge of upper platform 34. Accordingly, apron 80 and any bin that may be placed on table 50 is generally prevented from extending over the edge of upper platform 34 and is kept out of the way from those moving around the lift and tilt table.

In the preferred embodiment as shown in FIG. 3, when table 50 is lifted hydraulic cylinders 64 and arms 58 are caused to cross one another as seen in that figure. That is, the pivot pin 68 making the pivotal connection between table 50 and hydraulic cylinder 64 is closer to the table first end 54 than the pivot pin 62 making the pivotal connection between arms 58 and table 50. Furthermore, the pivot pin 66 making the pivotal connection between the hydraulic cylinder 64 and upper platform 34 is located inbetween the rollers 70 and pivot pin 60 making the pivotal connection between arms 58 and upper platform 34.

In the preferred embodiment as shown, the lift and tilt table is also made of formed stock steel such as steel sheets and brackets which are welded together in a known and customary manner.

While the invention has been described as having specific embodiments, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A table comprising:

a platform;

a table on said platform, said table having a first end and a second end;

means for lifting said table first end above said platform and simultaneously moving said table in a horizontal direction towards said table first end, whereby a center of gravity of said table is retained vertically above the general vicinity of an area on said platform and whereby articles placed on said table are tilted towards said table second end; and, scissor lift means below said platform and connected between said platform and a lower platform for lifting said platform vertically above said lower platform.

2. The table of claim 1 wherein said means for lifting and simultaneously moving comprises:

an arm pivotally connected at one end to said platform and pivotally connected at its other end to said table;

means for retaining said table second end in sliding engagement with said platform; and, extension means pivotally connected at one end to said platform and pivotally connected at its other end to said table for selectively pushing said table first end vertically upwardly and in a direction towards said table first end.

3. The table of claim 2 wherein said extension means comprising a selectively energized hydraulic cylinder.

4. The table of claim 2 wherein said retaining means comprises a channel attached to said platform and a roller connected to said table second end and engaging said channel.

5. The table of claim 2 further comprising an apron attached to said table second end and extending upwardly therefrom, whereby articles placed on said table are prevented from sliding off therefrom when said table first end is lifted above said platform.

6. The table of claim 2 wherein said pivotal connection between said table and said extension means is closer to said table first end than said pivotal connection between said arm and said table.

7. The table of claim 6 wherein said pivotal connection between said extension means and said platform is located inbetween said retaining means and said pivotal connection between said arm and said platform.

8. The table of claim 6 wherein said extension means comprises a selectively energized hydraulic cylinder.

9. A table comprising:

a platform;

a table on said platform, said table having a first end and a second end;

means for lifting said table first end above said platform and simultaneously moving said table in a horizontal direction towards said table first end including, an arm pivotally connected at one end to said platform and pivotally connected at its other end to said table, means for retaining said table second end in sliding engagement with said platform, and extension means pivotally connected at one end to said platform and pivotally connected at its other end to said table for selectively pushing said table first end vertically upwardly and in a direction towards said table first end whereby a center of gravity of said table is retained vertically above the general vicinity of an area on said platform and whereby articles placed on said table are tilted towards said table second end.

10. The table of claim 9 wherein said extension means comprises a selectively energized hydraulic cylinder.

11. The table of claim 10 wherein said extension means comprises a second selectively actuated hydraulic cylinder.

12. The table of claim 9 wherein said retaining means comprises a channel attached to said platform and a roller connected to said table second end and engaging said channel.

13. The table of claim 9 wherein said retaining means comprises a plurality of channels attached to said platform and a plurality of rollers connected to said table second end and engaging a respective channel.

14. The table of claim 9 further comprising an apron attached to said table second end and extending upwardly therefrom, whereby articles placed on said table are prevented from sliding off therefrom when said table first end is lifted above said platform.

15. The table of claim 9 wherein said pivotal connection between said table and said extension means is closer to said table first end than said pivotal connection between said arm and said table.

16. The table of claim 15 wherein said pivotal connection between said extension means and said platform is located inbetween said retaining means and said pivotal connection between said arm and said platform.

17. The table of claim 16 further comprising a second arm pivotally connected at one end to said platform and pivotally connected at its other end to said table, a second means for retaining said table second end in sliding engagement with said platform and a second extension means pivotally connected at one end to said platform and pivotally connected at its other end to said table for selectively pushing said table first end vertically upwardly and in a direction towards said table first end.

18. The table of claim 9 further comprising a second arm pivotally connected at one end to said platform and pivotally connected at its other end to said table, a second means for retaining said table second end in sliding engagement with said platform and a second extension means pivotally connected at one end to said platform and pivotally connected at its other end to said table for selectively pushing said table first end vertically upwardly and in a direction towards said table first end.

* * * * *

UNITED STATES PATENT AND TRADEMARK OFFICE

CERTIFICATE OF CORRECTION

PATENT NO. : 5,400,720

DATED : March 28, 1995

INVENTOR(S) : Jay B. Stevens

It is certified that error appears in the above-identified patent and that said Letters Patent is hereby corrected as shown below:

Column 3, line 62, change "2145" to --2-5--.

Signed and Sealed this

Twenty-third Day of May, 1995

*Attest:*

*Attesting Officer*

BRUCE LEHMAN

*Commissioner of Patents and Trademarks*